US005457944A

United States Patent [19]

Lipes

[11] Patent Number: 5,457,944

[45] Date of Patent: Oct. 17, 1995

[54] WICKET FOR BAGGING MACHINE

[76] Inventor: Arnold Lipes, 384 Olivier, Westmount, Quebec, Canada, H3Z 2C9

[21] Appl. No.: 288,603

[22] Filed: Aug. 10, 1994

[30] Foreign Application Priority Data

Feb. 10, 1992 [GB] United Kingdom ..... 9202758

[51] Int. Cl.[6] ..... B65B 43/14

[52] U.S. Cl. ..... 53/572; 53/390; 53/570; 206/554; 383/9; 248/100

[58] Field of Search ..... 53/390, 570, 572, 53/571; 248/97, 99, 100; 206/554; 383/9, 109; 141/114, 314; 493/196

[56] References Cited

U.S. PATENT DOCUMENTS

| | | | |
|---|---|---|---|
| 2,528,997 | 11/1950 | Blanchard | 53/572 |
| 3,064,652 | 11/1962 | Corcoran et al. | 383/9 |
| 3,281,056 | 8/1965 | Kugler | 206/554 |
| 4,981,216 | 1/1991 | Wilfong, Jr. | 248/100 |
| 5,013,290 | 5/1991 | DeMatteis | 383/109 |
| 5,183,158 | 2/1993 | Boyd et al. | 206/554 |

*Primary Examiner*—John Sipos
*Assistant Examiner*—Ed Tolan

[57] ABSTRACT

A wicket for a bagging machine is useful for placing a plurality of objects in a first bag (11) of a plurality of juxtaposed bags. Each bag has a front (17) and back (16) wall portion and an extended tab (13). The extended tab 13 has at least two wicket apertures (18) and the bottom of the bag 71 has at least one bottom wicket aperture (19). The bags are held in a wicket comprising upper wicket pins (12) and lower wicket pin (14). Lower wicket pin holds the bottom (71) of the bag. Lower wicket pin (14) aids in overcoming difficulties experienced with bags sticking to one another. The bag mouth is opened, e.g. with an air jet, and then clamped and pulled open. The machine is useful for packaging liquid-filled pouches, vegetables and the like in bags which are placed in a case or box.

3 Claims, 3 Drawing Sheets

WICKET FOR BAGGING MACHINE

Figure 1:
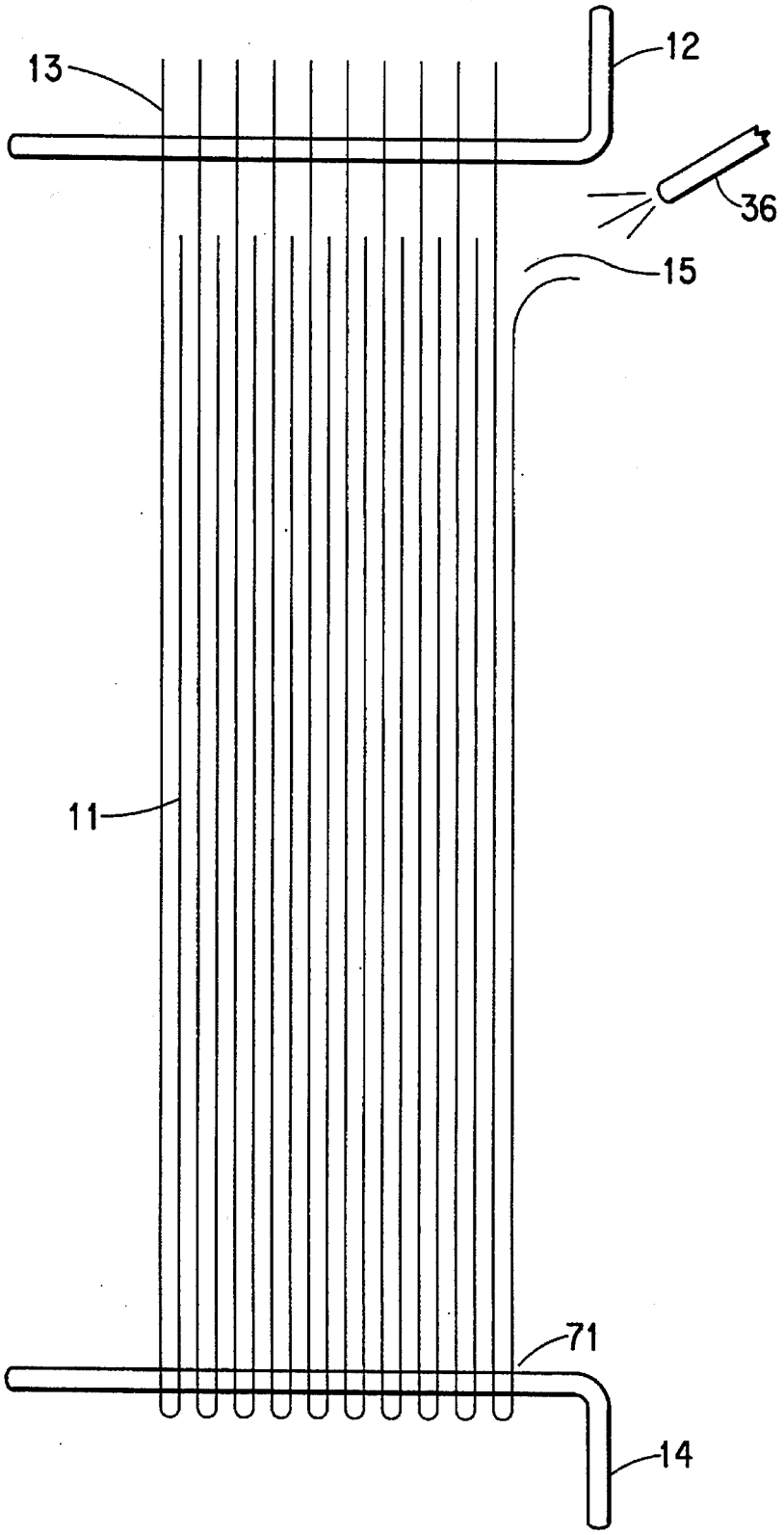

The present invention relates to wicket for a bagging machine and the method of operation thereof, and more particularly to a wicket suitable for bagging goods in thin plastic bags.

Bagging machines, with wickets, for holding, transporting, filling and/or sealing plastic bags are well known in the art. Examples of such a machine is disclosed in U.S. Pat. No. 4,253,292 to Arnold Lipes, which issued Sep. 29, 19881 and U.S. Pat. No. 3,789,573 to J. R. Crabb, which issued Feb. 5, 1974. Although such machines have been used successfully for packaging materials such as pluralities of carrots, difficulties are sometimes experienced when packaging materials in thin plastic bags because there is a tendency for the bags to stick to one another as a result, for example, of the presence of static electricity or water, or side seams of the bags sticking together. It has been found that such difficulties may be overcome by the simple but effective expedient of having a wicket pin at the bottom of the stack of bags in addition to the-wicket pins at the top of the stack.

Accordingly the present invention provides a wicket for a bagging machine, which is adapted to hold a plurality of juxtaposed bags, each bag having a front wall portion and a back wall portion, said front and back portions being adjoined at sides and bottom of said bag, and an extended tab secured to the back portion thereof, said tab extending above a mouth opening of said bag, said wicket comprising an upper wicket holding means adapted to hold the extended tabs of the juxtaposed plurality of bags thereon and at least one lower wicket pin adapted to hold the bottoms of the juxtaposed plurality of bags thereon.

In one embodiment the upper wicket holding means comprises at least two upper wicket pins.

It will be understood by those skilled in the art that, when the upper wicket holding means comprises wicket pins, each tab has apertures therein which correspond to the positions of the upper wicket pins and that the bottom of each bag has an aperture or apertures corresponding to the lower wicket pin(s).

In one embodiment there is only one lower wicket pin located such that it is at the bottom of the bags and substantially in the centre between the sides of the bags.

The invention also provides a bagging machine adapted to place articles in wicketted bags, wherein the machine has a wicket which is adapted to hold a plurality of juxtaposed bags, each bag having a front wall portion and a back wall portion, said front and back portions being adjoined at sides and bottom of said bag, and an extended tab secured to the back portion thereof, said tab extending above a mouth opening of said bag, said wicket comprising an upper wicket holding means adapted to hold the extended tabs of the juxtaposed plurality of bags thereon and at least one lower wicket pin adapted to hold the bottoms of the juxtaposed plurality of bags thereon.

In one embodiment the upper wicket holding means comprises at least two upper wicket pins.

The invention also provides a process for filling a bag with a plurality of objects, on a bagging machine which is adapted to place said objects in a first bag of a plurality of juxtaposed plastic bags held in a wicket on said machine, in which said wicket is adapted to hold a plurality of juxtaposed bags, each bag having a front wall portion and a back wall portion, said front and back portions being adjoined at sides and bottom of said bag, and an extended tab secured to the back portion thereof, said tab extending above a mouth opening of said bag, said wicket comprising an upper wicket holding means adapted to hold the extended tabs of the juxtaposed plurality of bags thereon and at least one lower wicket pin adapted to hold the bottoms of the juxtaposed plurality of bags thereon, said process comprising:

a) holding the extended tabs of the juxtaposed bags with the upper wicket holding means, and holding the bottoms of said juxtaposed bags with the lower wicket pin(s);

b) opening the mouth of a first bag of said juxtaposed bags such that said opening causes the bottom of the first bag to become disengaged from the lower wicket pin(s);

c) holding the mouth of said first bag in an open position; and d) dropping objects into said bag mouth.

In one embodiment there is only one lower wicket pin and the plastic bags each have an aperture in the bottom corresponding to the positioning of the lower wicket pin.

In another embodiment the bottom of each bag is constructed such that the bottom of each bag is essentially leak-proof in addition to having an aperture therein.

In a further embodiment the upper wicket holding means comprises at least two upper wicket pins.

In yet another embodiment the bags are made of polyethylene having a thickness of from about 20 to about 50 micrometers.

In a further embodiment an open-mouthed case is positioned such that the opened bag mouth is above the mouth of the case; objects are dropped into said bag mouth, causing the front bag wall to be pulled into the case; and when the desired number of objects are in the bag, the bag mouth is released.

The invention further provides a process for filling a bag with a plurality of objects and for placing filled the bag in an open-mouthed case, on a bagging machine which is adapted to place said objects in a first bag of a plurality of juxtaposed plastic bags held in a wicket on said machine, each bag having a front wall portion and a back wall portion, said front and back portions being adjoined at sides and bottom of said bag, and an extended tab secured to the back portion thereof, said tab extending above a mouth opening of said bag, said process comprising:

a) holding an unopened first bag of the juxtaposed bags such that the first bag hangs down at the side of the case and such that the mouth of the first bag is above a plane which passes through the mouth of the case, and such that the bottom of the first bag is held temporarily by at least one wicket pin;

b) opening the mouth of the first bag such that the mouth of the first bag is situated above the case and the front wall of the first bag extends from the mouth, over an upper edge of the case, to the bottom of the first bag, said opening of the mouth causing the bottom of the bag to be released from the wicket pin; and c) dropping objects into the first bag through the open bag mouth onto the inner surface of the front wall, causing the bottom of the first bag to be pulled into the case.

The invention also provides a wicketted bag having a front wall portion and a back wall portion, said front and back portions being adjoined at sides and bottom of said bag, and an extended tab, secured to the back portion thereof, said tab extending above a mouth opening of said bag, the improvement wherein the bottom of the bag has at least one wicket aperture (sometimes referred to herein as the bottom wicket aperture).

In one embodiment the tab has at least two wicket apertures therein.

In another embodiment the bottom of the bag is constructed such that bottom wicket aperture does not communicate with the inside of the bag.

Figure 3:
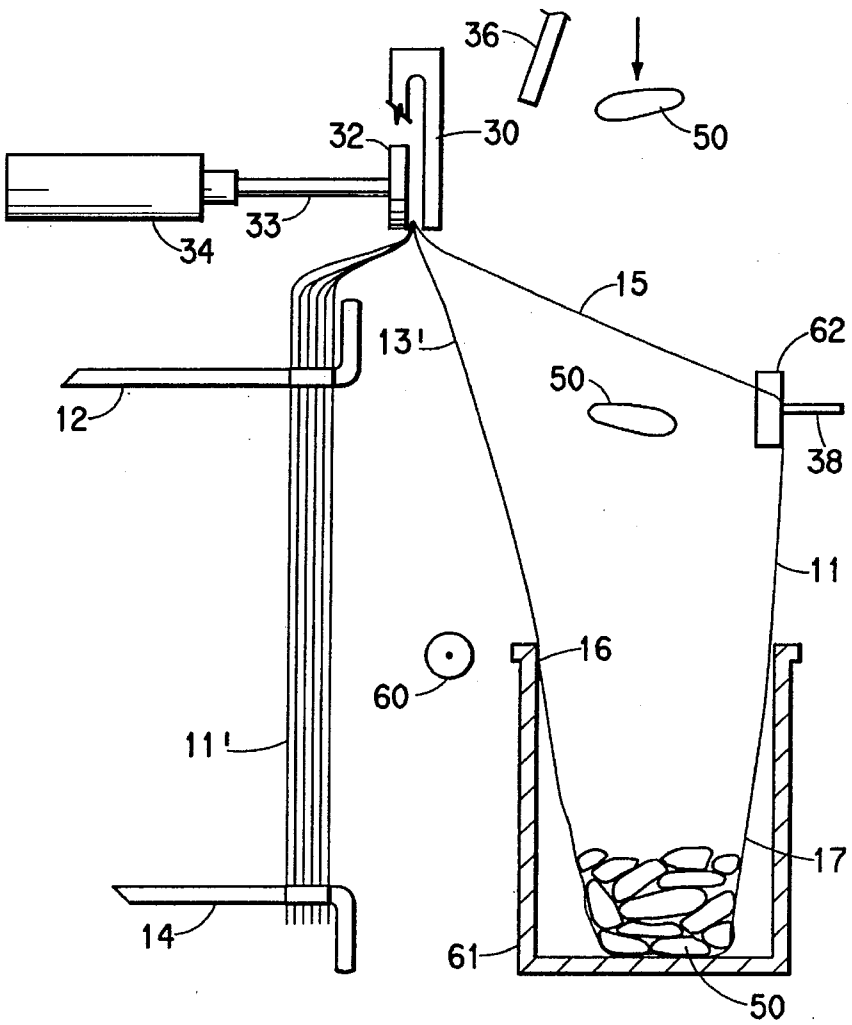
Figure 2:
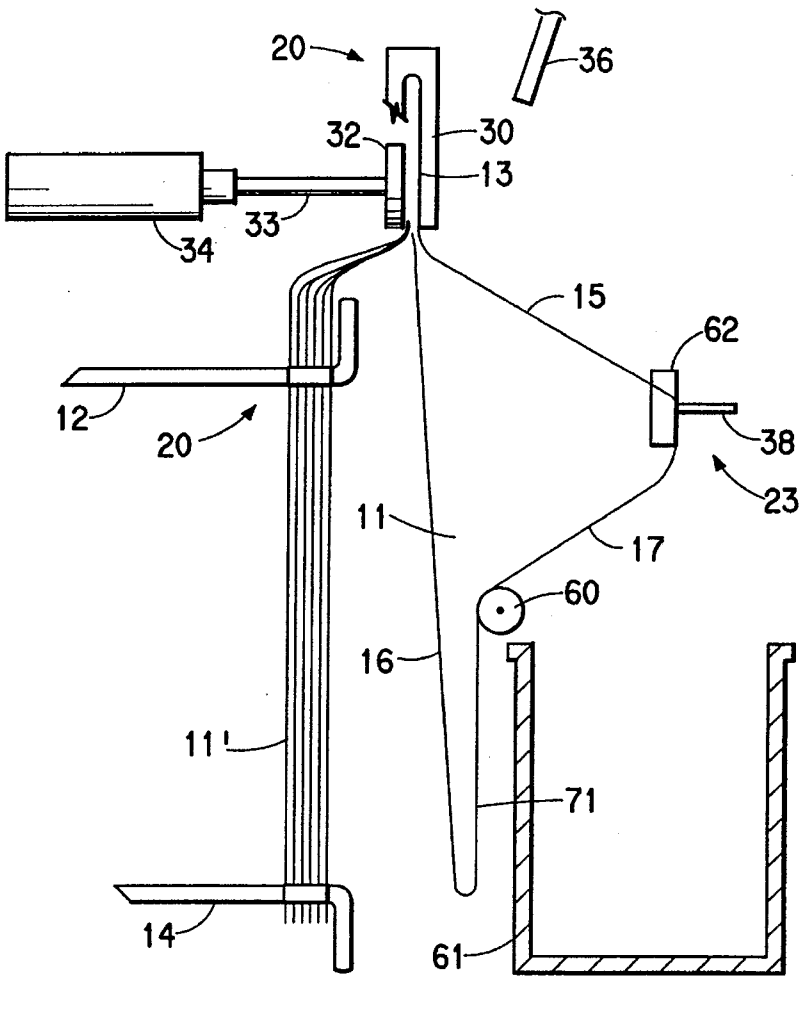
Figure 4A:
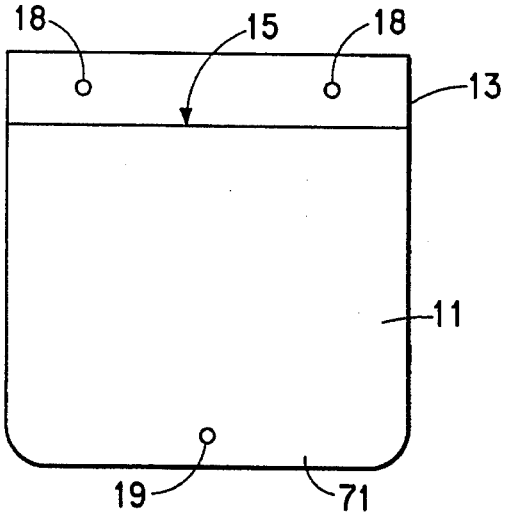
Figure 4B:
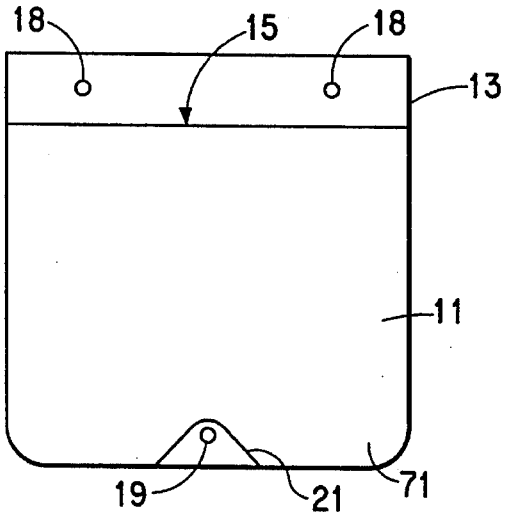
Figure 4C:
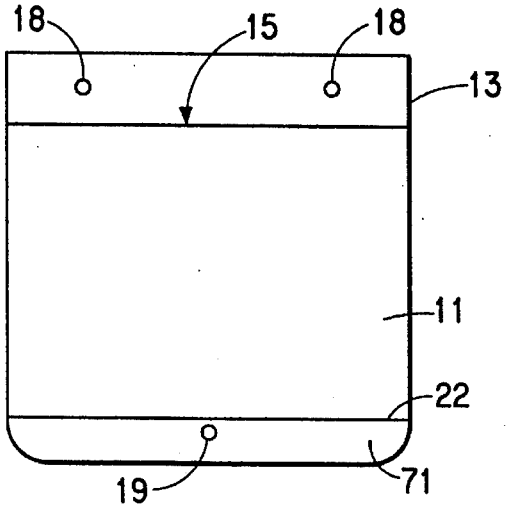

A preferred embodiment of the invention will now be described with reference to the drawings. FIG. 1 is a schematic view illustrating the positioning of the juxtaposed bags in the wicket of a bagging machine. FIGS. 2 and 3 are a schematic views showing operation of said machine. FIGS. 4*a*, 4*b* and 4*c* are front views of bags suitable for use with the wicket of the present invention.

Referring to the drawings, especially FIGS. 2 and 3, there are shown parts of an automatic bagging machine for holding and opening a first bag 11 of a plurality of bags 11' held in the machine by upper wicket pins 12 and lower wicket pin 14. Each of the bags 11 has an extended tab 13 provided with two spaced apart apertures 18 (FIGS. 4*a*, *b* and *c*). Apertures 18 allow bags to be slidingly retained on the upper wicket pins 12. Each bag is also provided with a mouth 15, defined between rear bag wall 16 and front bag wall 17. Each bag is further provided with an aperture 19 (FIGS. 4*a*, *b* and *c*) at the bottom of the bag. Such aperture 19 allows the bottoms of the bags to be slidingly retained on the lower wicket pin 14. Although not shown in the drawings the bags may have side and/or bottom gussets therein at the portions where the front and back walls adjoin.

The machine includes holding means 20 for engaging at least a portion of the extended tab 13 of the bags 11. A displaceable clamp 32 is secured to the free end of a piston rod 33 of piston 34. The clamping surface of the displaceable clamp 32 is positioned in alignment with the clamping surface of the stationary clamp 30 whereby all of the extended tabs 13 are held compressed between the clamping surfaces when the piston rod 33 is displaced outwardly from the piston cylinder 34.

The bag opening means comprises an air jet 36, a bag mouth clamp 62, and retractor member 38. Air jet 36 is positioned above and adjacent the mouth opening 15 of the first bag in order to direct a jet of air into the mouth opening. Blowing air through jet 36 causes the mouth 15 of the first bag to open and to permit the insertion of bag clamp 62. Bag clamp 62 is shown in simplified form in the drawings and the actual construction will be known to those skilled in the art.

As retractor member 38 is moved away from stationary clamp 30, the front wall 17 is pulled away from the back wall 16. Extended tab 13, which continues to be held by stationary clamp 30, is ripped away from upper wicket pins 12. Additionally, the bottom 71 of the bag is ripped away from lower wicket pin 14.

As will be seen in FIG. 2, as retractor member 38 is pulled away from stationary clamp 30, front wall 17 is pulled over roller 60. It is not essential that roller 60 be present because the front wall 17 would be pulled over the upper lip of case 61. However, in practice the cases are reused and tend to become damaged, particularly at the lip, causing there to be snags on the lip. Such snags may damage the front wall 17 as it is pulled over the lip, so roller 60, a bar or similar is preferred. As indicated hereinabove, extended tab 13 is pulled off wicket pins 12. To facilitate disconnection, a sharp edge may be provided along the top of upper wicket pins 12. Similarly, to facilitate disconnection of the bottom of the bag from lower wicket pin 14, the lower wicket pin may be provided with a sharp edge along the bottom of pin 14. When packaging objects, such as liquid-filled pouches, it is usual to drop pouches 50 into bag 11 one at a time until a defined number of pouches are in the bag. In this case, bag disconnection from clamp 30 takes place at the bag release stage.

After a predetermined quantity or weight of material 50 is inserted into bag 11, piston 34 is again activated to perform the release stroke. Piston 34 retracts its piston rod and therefore releases the extended tab 13. Simultaneously retractor member 38 and clamp 62 are caused to release the bag mouth. Thus the bag 11 is free to fall by gravity.

As will be understood by those skilled in the art, after the bag 11 has been filled with objects, e.g. pouches 50, and the bag starts to pull free from wicket pins 12, it is desirable to control the mouth of the bag in order to seal the bag mouth and this may be done in a number of known ways. A suitable sealing operation is described, for example, in Canadian Patent 1 260 884 which issued Sep. 26 1989 to Lipes and Soga.

The apparatus described herein is particularly useful for bags made of plastic films such as polyethylene, and especially thin plastic films. As indicated hereinbefore, the wicketted bags have apertures positioned to allow the bags to be placed on wicket pins 12 and 14. As will be clear, aperture 19 in the bottom of the bag is required in order to hold the bags on the lower wicket 14. When the bag is full of product, e.g. liquid-filled pouches, vegetables or the like, the aperture may cause there to be a source of weakness to the bag bottom. Alternatively, it may be desirable to have a bag which is substantially leak-proof. In both of these situations it may be preferable to place the bottom aperture in a portion which is sealed off from the interior of the bag. This may be accomplished by heat sealing around the aperture with a heat seal 21 as shown for example in FIG. 4*b*. Aperture 19 may also be segregated from the interior of the bag by a full seal 22 across the bottom of the bag, as shown in FIG. 4*c*. It is preferred that there be only one lower aperture and one corresponding lower wicket pin, but two or more may also be used.

I claim:

1. A wicket for a bagging machine, which is adapted to hold a plurality of juxtaposed bags, each bag having a front wall portion and a back wall portion, said front and back portions being adjoined at sides and bottom of said bag, and an extended upper tab secured to the back portion thereof, said upper tab extending above a mouth opening of said bag, and an extended lower tab secured to the bottom of the bag, said lower tab having a hole and extending below the bottom of said bag, said wicket comprising:

an upper wicket holding means adapted to hold the extended upper tabs of the juxtaposed plurality of bags thereon; and at least one lower wicket pin adapted to protrude through the hole of the lower tab of the juxtaposed plurality of bags thereon.

2. A wicket for a bagging machine according to claim 1 wherein the upper wicket holding means comprises at least two upper wicket pins.

3. A bagging machine adapted to place articles in wicketted bags, having a wicket of claim 1 or claim 2.

* * * * *